United States Patent [19]

Nachbur et al.

[11] 4,288,489

[45] Sep. 8, 1981

[54] PROCESS FOR FLAMEPROOFING ORGANIC FIBROUS MATERIAL WITH PHOSPHONIC ACID SALTS

[75] Inventors: Hermann Nachbur, Dornach; Peter Rohringer, Schönenbuch, both of Switzerland

[73] Assignee: Ciba-Geigy Corporation, Ardsley, N.Y.

[21] Appl. No.: 8,217

[22] Filed: Jan. 31, 1979

[30] Foreign Application Priority Data

Feb. 6, 1978 [CH] Switzerland ..... 1279/78
Jan. 10, 1979 [CH] Switzerland ..... 214/79

[51] Int. Cl.[3] ..... B32B 7/00; D04H 1/58; B05D 3/02; D06M 9/00

[52] U.S. Cl. ..... 428/265; 8/115.6; 8/115.7; 8/116 P; 427/394; 428/276; 428/289; 428/921

[58] Field of Search ..... 8/116 P, 115.6, 115.7; 427/390 D, 394, 393.3; 260/45.7 P, 553 G; 428/480, 500, 532, 921, 165, 276, 289

[56] References Cited

U.S. PATENT DOCUMENTS 3,894,986 7/1975 Racky et al. ..... 260/45.7 P
3,954,866 5/1976 Frank et al. ..... 8/116 P
3,963,437 6/1976 LeBlanc et al. ..... 8/192
4,080,480 3/1978 Reinhardt et al. ..... 8/116 P
4,092,108 5/1978 Vallco et al. ..... 8/116 P
4,144,387 3/1979 Anderson et al. ..... 8/116 P

FOREIGN PATENT DOCUMENTS 2266764 4/1975 France .
1317468 5/1973 United Kingdom .

OTHER PUBLICATIONS

*Alkylphosphonic & Dialkylphosphonic Acids*, pp. 3379-3382, Jul. 20, 1953.

*Primary Examiner*—Michael R. Lusignan
*Attorney, Agent, or Firm*—Edward McC. Roberts; John P. Spitals

[57] ABSTRACT

A process for the non-permanent flameproofing of organic fibrous materials with monoammonium or monoalkali metal salts of an alkylphosphonic acid is claimed. Monoammonium methyl- and ethylphosphonate are also claimed. The claimed process is suitable for a very wide variety of fibrous materials. The flame-retardants used according to the invention have no corrosive action and have excellent compatability with most other textile finishing agents.

9 Claims, No Drawings

PROCESS FOR FLAMEPROOFING ORGANIC FIBROUS MATERIAL WITH PHOSPHONIC ACID SALTS

The invention provides a process for flameproofing organic fibrous material which comprises treating said material with an aqueous solution of a phosphonic acid salt of the formula

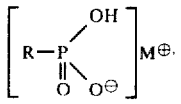

(1)

wherein R represents ethyl or preferably methyl and $M^{\oplus}$ represents an alkali metal cation or ammonium cation, and drying it.

The alkali metal cations are derived for example from lithium, potassium or in particular from sodium. The monoammonium salts are preferred to the alkali metal salts. The invention provides in particular a process wherein monoammonium methylphosphonate is used as flame-retardant.

The salts of the formula (1) employed according to the invention are obtained by reaction of the corresponding acids with the corresponding bases and are ordinarily in the form of 30 to 50% aqueous solutions. The alkylphosphonic acids themselves are known for example from J. Am. Soc. 75, 3379 ff. (1953). The same applies also to the alkylphosphonic acid alkali metal salts, which are disclosed for example in U.S. Pat. No. 3,894,986.

The process of the invention is carried out in general by the spray-on method and also in particular by the pad method. The immersion or slop-pad methods for example are also eligible.

As the phosphonic acid salts of the formula (1) are water-soluble, it is normally not necessary to add solubilising assistants to the treatment baths, liquors or spray solutions. However, conventional fabric softeners, surfactants or buffer substances, such as urea, dicyandiamide, hexamethylenetetramine, acid ammonium sulfates or phosphates or sodium acetate can be concurrently used with advantage.

In the preferred pad method, the phosphonic acid salt solutions are applied to the fibrous material to a liquid pick-up of 60 to 110, preferably 60 to 100 and especially 65 to 80% by weight, and the impregnated material is subsequently dried at a temperature between 60° and 120° C., preferably however below 100° C., for example between 60° and 100° C. and in particular between 70° and 90° C.

The process of the present invention is suitable for flameproofing organic fibrous material, including wood, preferably paper, for example wall-papers, or especially textiles in any stage of processing, such as filaments, yarns, bobbins, bonded fibre webs, knits, wovens or finished garment pieces, or furnishing materials, such as carpets, furniture coverings, curtains or fabric-covered wall-papers.

The organic fibrous material to be provided with the flame-retardant finish can be of natural or synthetic origin or can consist of blends of natural and synthetic fibres. Suitable natural fibres are in particular keratinous or cellulosic fibres, including fibres made from regenerated cellulose, such as linen, hemp, sisal, ramie, preferably wool, cotton and/or rayon, staple fibres or filament viscose.

In addition to pure cellulose fibres, blends thereof with synthetic fibres are also suitable. The cellulose content of such blends is preferably 20 to 80%. Examples of suitable synthetic fibres are polyester, preferably acrylonitrile copolymer, or in particular polyacrylonitrile fibres. Although less preferred, cellulose acetate fibres, for example cellulose 2½-acetate and cellulose triacetate, and fibres obtained from crosslinked polyvinyl alcohols, for example acetates or ketals of polyvinyl alcohols, are also suitable.

In addition, however, to cellulose fibres and their blends with synthetic fibres, man-made synthetic fibrous material is particularly preferred, especially that made from polyester or especially polyacrylonitrile or acrylonitrile copolymers. Polyacrylonitrile wall-papers can be particularly well flameproofed according to the invention. Such polyester fibres are derived in particular from terephthalic acid, for example from poly(ethylene glycol terephthalate) or poly(4-cyclohexylenedimethylene terephthalate).

The acrylonitrile content of acrylonitrile copolymers is desirably at least 50% by weight and preferably at least 85% by weight of the copolymer. The copolymers are in particular those in the production of which other vinyl compounds, for example vinyl chloride, vinylidene chloride, methacrylates, acrylamide or styrenesulfonic acids, have been used as comonomers.

The aqueous solutions with which these fibrous materials are treated contain ordinarily 25 to 500 g/kg of the phosphonic acid salt of the formula (1).

Especially when treating man-made synthetic fibrous materials, for example polyester material, by the preferred pad method, bath concentrations of 25 to 100 g/kg often suffice, particularly when the ammonium salt is used. Preferably, however, the padding is carried out using bath concentrations of 200 to 450 g/kg, especially when flameproofing polyacrylic fibres.

The pH value of the solutions employed in the present invention is normally from 4 to 8 and is adjusted by the addition of a base, for example an alkali hydroxide, ammonia, or buffer substances of the indicated kind.

The amounts of compound of the formula (1) required to obtain a sufficient flame-retardant effect vary depending on the nature of the fibre and material and are normally between 2 and 25%, based on the weight of the fibre.

The process of the present invention does not provide permanent flame-retardant effects, for which reason the treated fabrics should not be given a washing-off.

The process of the present invention is distinguished in particular by the fact that a very wide variety of substrates can be provided with an effective flame-retardant finish by means of it and that the compositions employed do not have a corrosive action—a feature which is especially advantageous when stapling treated wall-papers, for example in decorating.

The flame-retardant finishes of the present invention have virtually no effect on the lightfastness of dyed or whitened polyester and polyacrylonitrile fabrics. The good compatibility of the phosphonic acid salts used according to the invention with most textile finishing agents, such as water and oil repellents, stiffeners and fabric softeners, is particularly advantageous.

A further advantage of the process of the invention resides in the low add-ons required for flameproofing polyester fibres.

In the following Examples the parts and percentages are by weight.

EXAMPLE 1

Different fabrics are padded with an aqueous liquor of the composition indicated in Table I and dried for 30 minutes at 80° C. After conditioning for 12 hours at 45% relative humidity, the flame-retardant effect according to DOC FF 3-71 (ignition time 3 seconds) is carried out. The results are also reported in Table I. Untreated fabrics burn away.

TABLE I

| | Nature and weight per unit area of the treated fabric | | | | | | | | | | | | | | |
|---|---|---|---|---|---|---|---|---|---|---|---|---|---|---|---|
| | cotton (140 g/m²) | | | polyester/cotton 67:33 (167 g/m²) | | | polyester (200 g/m²) | | | | | polyacrylonitrile (138 g/m²) | | | |
| monoammoniummethylphosphonate (100%) g/kg | 75 | 75 | — | 359 | 385 | — | — | 25 | 44 | 33 | 45 | 312 | 376 | 345 | 371 |
| monosodiummethylphosphonate (100%) g/kg | — | — | 200 | — | — | 354 | 371 | — | — | — | — | — | — | — | — |
| pH-value of the liquors | 5.5 | 7.1 | 5.35 | 5.5 | 7.1 | 4.9 | 5.35 | 5.5 | 5.5 | 7.1 | 7.1 | 5.5 | 5.5 | 7.1 | 7.1 |
| add-on of phosphonate after drying (%) | 5.2 | 4.6 | 14.7 | 20.3 | 22 | 20.6 | 24.5 | 2.2 | 3.5 | 2.8 | 3.6 | 24.5 | 30.9 | 26.3 | 33.1 |
| flame-resistance | | | | | | | | | | | | | | | |
| combustion time (sec) | 0 | 10 | 0 | 0 | 5. | 0 | 6 | 0 | 5. | 0 | 6 | 1 | 5. | 1 | 3. |
| tear length (cm) | 0 | 8.5 | 7 | 0 | 5.5 | 0 | 4 | 0 | 6 | 0 | 6.5 | 0 | 1.5 | 0 | 1.5 |

EXAMPLE 2

The fabrics listed in Table II are padded with aqueous liquors of the composition also indicated in the table. The results of the flame-retardant test after conditioning and drying as described in Example 1 are likewise reported in the table. The flame-retardant test is also carried out in accordance with DOC FF 3-71, but with the ignition time stated in Table II. The untreated corresponding fabrics burn away completely.

TABLE II

| | Nature and weight per unit area of the fabric | | | | | |
|---|---|---|---|---|---|---|
| | furnishing material made of polyacrylonitrile (195g/m²) | mattress material made of viscose (140g/m²) | velours consisting of 40% of polyacrylonitrile and 60% of cotton (315g/m²) | | upholstery plush consisting of 40% of polyacrylonitrile and 60% of cotton (415g/m²) | | wall-paper* of polyacrylonitrile (250g/m²) | |
| monoammoniummethylphosphonate (40%) g/l | 600 | 200 | 400 | | 400 | | 1000 | 1000 |
| condensation product of 1 mole of p-nonylphenol and 9 mole of ethylene oxide (100%) g/l | — | 2 | — | | — | | — | 2 |
| polyvinyl acetate (50%) g/l | — | 50 | — | | — | | — | 40 |
| p-H-value of the liquor | 5.3 | 5.5 | 5.4 | | 5.4 | | 5.1 | 5.2 |
| liquor pick-up (%) | 110 | 100 | 75 | | 85 | | 65 | 70 |
| add-on of monoamonium methylphosphonate after drying (%) | 26.4 | 8.0 | 12.0 | | 13.6 | | 26.6 | 28.0 |
| flame resistance | | | | | | | | |
| ignition time (sec.) | 12 | 12 | 3 | 15 | 3 | 15 | 12 | 12 |
| after-flame time (sec.) | 0 | 0 | 0 | 0 | 0 | 0 | 0 | 0 |
| tear length (cm) | 12 | 15 | 2.5 | 8.5 | 2 | 7 | 12.5 | 12.5 |

Wall-paper consisting of a cellulose web sprayed on the back with styrene and dried and subsequently pasted with polyacrylonitrile fibres

EXAMPLE 3

A viscose fabric having a weight per unit area of 180 g/m² is padded with an aqueous liquor which contains 200 g/l of monoammonium methylphosphonate (40%) and 200 g/l of polyvinyl acetate (50%) and has a pH value of 5.5. The liquor pick-up is 90% and the add-on of phosphonate after drying at 120° C. for 10 minutes is 7.2%. The fabric is then coated by the floating blade coating method on both sides with an aqueous viscous solution consisting of 1000 parts of polyvinyl acetate (50%), 150 parts of monoammonium methylphosphonate (40%), 10 parts of hydroxyethyl cellulose (100%) and 30 parts of ammonia (30%). The pH of the solution is 8 and the add-on is 140 g/m² on each side of the fabric. The coated fabric is dried for 5 minutes at 120° C. and further processed to light protective lamellae which are tested in accordance with DOC FF 3-71 with an ignition time of 3 seconds. The after-flame time and tear length of the warp is 0 seconds and 5.5 cm respectively and the after-flame time and tear length of the weft is 0 seconds and 5 cm respectively. Light protective lamellae prepared without monoammonium methylphosphonate on the other hand burn away completely.

What is claimed is:

1. A process for flameproofing organic fibrous material which comprises treating said material with an aqueous solution containing 25 to 500 g/l of a phosphonic acid salt of the formula

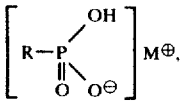

in which R is methyl or ethyl and $M^{\oplus}$ is an alkali metal cation or an ammonium cation, and drying it.

2. A process according to claim 1, in which monoammonium methylphosphonate is used as phosphonic acid salt.

3. A process according to claim 1 in which the fibrous material is treated by the pad method.

4. A process according to claim 1 in which the fibrous material is dried at 60° to 100° C.

5. A process according to claim 1 which comprises treating material made of synthetic or cellulosic fibers or blends thereof.

6. A process according to claim 1 which comprises treating polyacrylonitrile, polyester, polyester/cellulose or cellulose fibers.

7. A process according to claim 1 which comprises treating polyester fibers.

8. A process according to claim 1 which comprises treating polyacrylonitrile fibers.

9. Fibrous material flameproofed according to claim 1.

* * * * *